US005186362A

United States Patent [19]

Biagi, Jr.

[11] Patent Number: 5,186,362

[45] Date of Patent: Feb. 16, 1993

[54] LIQUID TRANSFER ASSEMBLY

[76] Inventor: Hugh A. Biagi, Jr., Rte. 1, Box 174A, Bagdad, Ky. 40003

[21] Appl. No.: 747,141

[22] Filed: Aug. 19, 1991

[51] Int. Cl.[5] ..... B67D 5/52

[52] U.S. Cl. ..... 222/136; 222/399; 222/400.8; 222/478

[58] Field of Search ..... 222/129, 135, 136, 144.5, 222/394, 399, 400.7, 400.8, 478

[56] References Cited

U.S. PATENT DOCUMENTS

| | | | |
|---|---|---|---|
| 692,523 | 2/1902 | Kammerer | 222/129 X |
| 1,548,186 | 8/1925 | Claude | 222/394 X |
| 2,599,560 | 6/1952 | Ketterer | 222/136 X |
| 3,604,602 | 9/1971 | Lee | 222/399 X |
| 3,880,330 | 4/1975 | Leas et al. | 222/136 |
| 4,085,782 | 4/1978 | Carlson | 222/129 X |
| 4,231,494 | 11/1980 | Greenwood | 222/394 X |
| 4,699,298 | 10/1987 | Grant et al. | 222/400.7 |

*Primary Examiner*—Andres Kashnikow
*Assistant Examiner*—Joseph A. Kaufman

[57] ABSTRACT

A liquid dispensing apparatus includes a stopper-type closure through which a plurality of tubes or straws can be directed to the interior portion of a liquid container. A retaining disk is positionable on a top surface of the stopper and has a triangularly-shaped aperture through which the plurality of straws are directed. A hinged holding clasp is positionable around a neck portion of the liquid container and includes slots for receiving both a flanged portion of the container and edge portions of the retaining disk so as to complete the assembly of the liquid dispensing apparatus. Air pressure may be supplied through one straw to force liquid out of a second straw while a further supply of air pressure is directed through the third straw to a serially connected container.

2 Claims, 5 Drawing Sheets

LIQUID TRANSFER ASSEMBLY

BACKGROUND OF THE INVENTION

1. Field of the Invention

The present invention relates to liquid dispensing systems and more particularly pertains to a liquid dispensing apparatus which may be attached to the neck of a flanged liquid container and which may then be utilized to selectively pressurize the container to remove liquid through an associated conduit.

2. Description of the Prior Art

The use of liquid dispensing systems is well known in the prior art. In this regard, many liquid dispensing systems are designed to facilitate a dispensing of the contents of a liquid container comprising a bottle or the like. For example, U.S. Pat. No. 3,434,629, which issued to Hooge et al on Mar. 25, 1969, discloses a mouth wash dispenser wherein a bottle of liquid mouth wash may be attached to a dispensing valve arrangement to facilitate a selective use thereof. Other liquid dispensing systems are designed to facilitate the interconnecting of a plurality of bottle-like containers in a manner similar to that envisioned by the present invention. Typical examples of these multiple liquid dispensing devices are to be found in U.S. Pat. No. 3,930,598 which issued to W. Slagle on Jan. 6, 1976; U.S. Pat. No. 4,033,483 which issued to S. Neidorf on Jul. 5, 1977; and U.S. Pat. No. 4,274,557 which issued to J. Shannon on Jun. 23, 1981.

In reviewing these prior art patents, it will be readily apparent that the systems and devices disclosed therein are complex in design and accordingly require a substantial manufacturing expense. The liquid dispensing apparatus according to the present invention substantially departs from the conventional concepts and designs of these prior art apparatuses, and in so doing provides and apparatus primarily developed for the purpose of connecting one or more bottle-like liquid containers together in an efficient and economical manner to effect the serial and concurrent dispensing of liquid therefrom. Therefore, it can be appreciated that there exists a continuing need for new and improved liquid dispensing apparatuses which can be efficiently operated and economically manufactured. In this respect, the present invention substantially fulfills this need.

SUMMARY OF THE INVENTION

In view of the foregoing disadvantages inherent in the known types of liquid dispensing apparatuses now present in the prior art, the present invention provides an improved liquid dispensing apparatus construction wherein the same can be utilized to serially connect a plurality of liquid containers to effect a concurrent dispensing of liquid therefrom. As such, the general purpose of the present invention, which will be described subsequently in grater detail, is to provide a new and improved liquid dispensing system which has all the advantages of the prior art liquid dispensing systems and none of the disadvantages.

To attain this, the present invention effectively comprises a liquid dispensing apparatus having a stopper-type closure through which a plurality of tubes or straws can be directed to the interior portion of a liquid container. A retaining disk is positionable on a top surface of this stopper and has a triangularly-shaped aperture through which the plurality of straws are directed. A hinged holding clasp is positionable around a neck portion of the liquid container and includes slots for receiving a flanged portion of the container and edge portions of the retaining disk so as to complete the assembly of the liquid dispensing apparatus. Air pressure may be supplied through one straw to force liquid out of a second straw while a further supply of air pressure is directed through the third straw to a serially connected container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved liquid dispensing apparatus which has all the advantages of the prior art liquid dispensing apparatuses and none of the disadvantages.

It is another object of the present invention to provide a new and improved liquid dispensing apparatus which may be easily and efficiently manufactured and marketed.

It is a further object of the present invention to provide a new and improved liquid dispensing apparatus which is of a durable and reliable construction.

An even further object of the present invention is to provide a new and improved liquid dispensing apparatus which is susceptible of a low cost of manufacture with regard to both materials and labor, and which accordingly is then susceptible of low prices of sale to the consuming public, thereby making such liquid dispensing apparatuses economically available to the buying public.

Still yet another object of the present invention is to provide a new and improved liquid dispensing apparatus which provides in the apparatuses and methods of the prior art some of the advantages thereof, while simultaneously overcoming some of the disadvantages normally associated therewith.

Still another object of the present invention is to provide a new and improved liquid dispensing apparatus which facilitates the inter connection of a plurality of bottle-like liquid containers to effect a concurrent dispensing of liquid therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
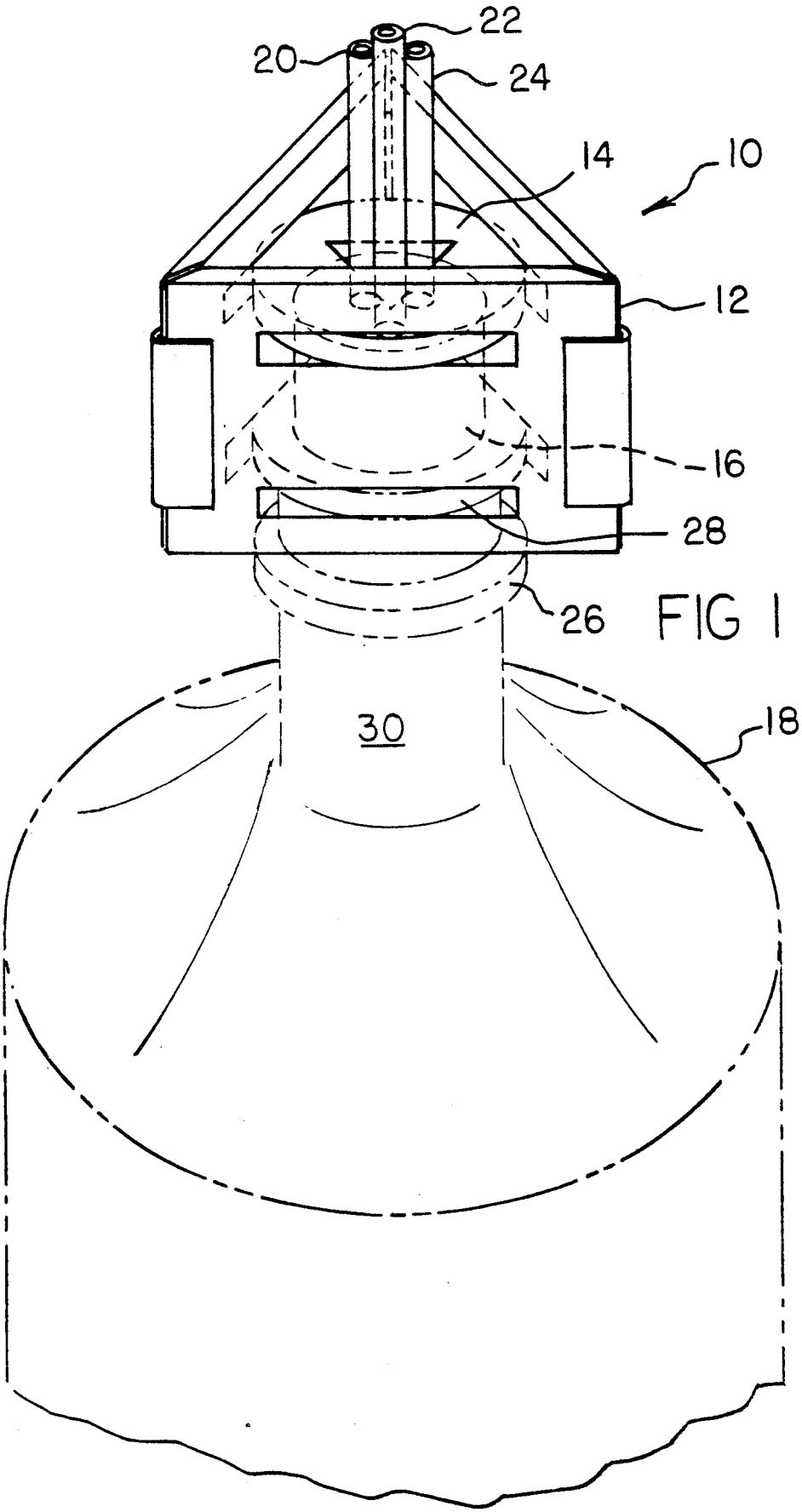
FIG. 1 is a perspective view of the present invention attached to the neck of a double-flanged bottle.

With reference now to the drawings, and in particular to FIGS. 1-6 thereof, a new and improved liquid dispensing apparatus embodying the principles and concepts of the present invention and generally designated by the reference numeral 10 will be described.

More specifically, it will be noted that the liquid dispensing apparatus 10, as initially illustrated in FIG. 1, essentially comprises a holding clasp 12, a retaining disk 14, a stopper-like closure 16 designed to be inserted into the opening of a bottle-like liquid container 18, and a plurality of fluid directing straws or tubes 20, 22, 24. The bottle 18 is representative of a plurality of different types of liquid-holding bottles and in this particular case, the bottle is shown with a pair of integrally molded flanges 26, 28 on the plastic neck portion 30 thereof. As illustrated, the liquid dispensing apparatus 10 is designed to grasp the topmost flange 28 when it is operably attached to the bottle 18.

Figure 2:
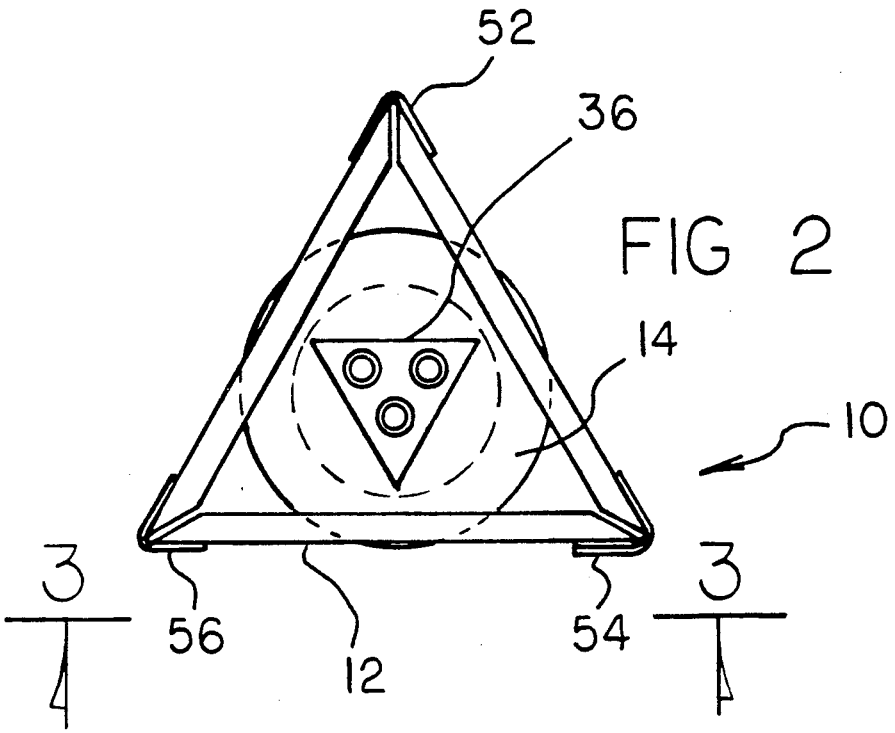
FIG. 2 is a top plan view of the invention.
Figure 3:
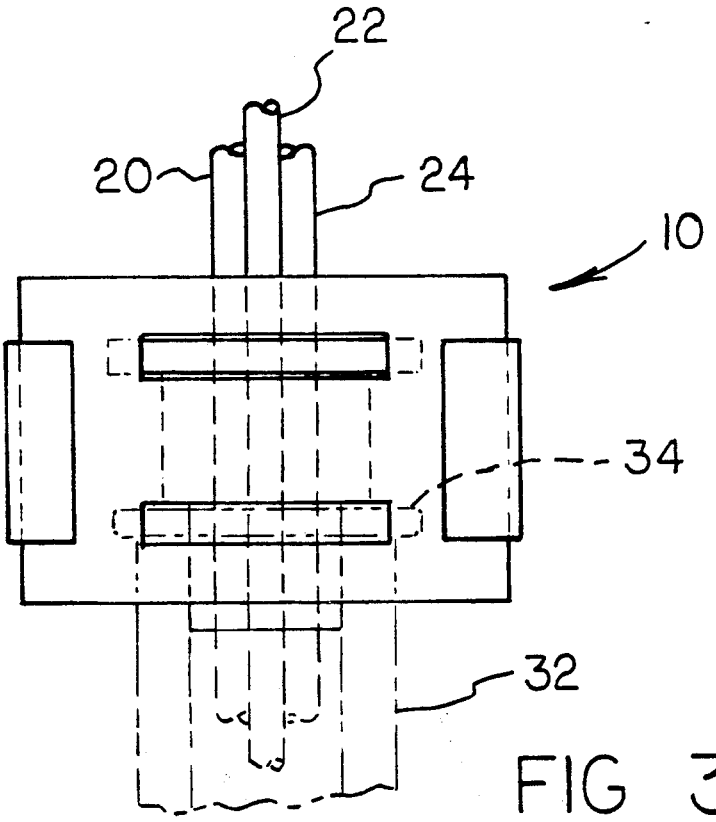
FIG. 3 is a side elevation view of the invention as viewed along the line 3—3 in FIG. 2.
Figure 4:
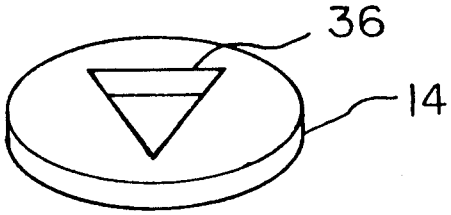
FIG. 4 is a perspective view of the retaining disk forming a part of the present invention.
Figure 5:
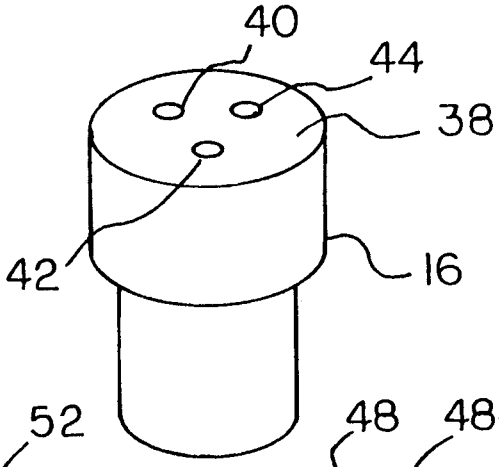
FIG. 5 is a perspective view of the stopper forming a part of the present invention.

FIGS. 2 and 3 illustrate the apparatus 10 attached to the bottle neck 32 of a bottle having only a single integral flange 34. To more effectively describe this manner of attachment, as well as the method of operation of the present invention, reference is made to FIGS. 4-6 wherein a more particular description of the operating components of the invention 10 is provided. As shown in FIG. 4, the retaining disk 14 is of a separable flat circular construction with a triangularly-shaped slot 36 being cut through the disk to permit the passage of the aforementioned straws 20, 22, 24 therethrough. The retaining disk 14 is designed to be positioned on the top surface 38 of the stopper-type closure 16 as shown in FIG. 5. The stopper 16 is provided with a plurality of axially-aligned through-extending apertures 40, 42, 44 which respectively receive the tubes 20, 22, 24.

Figure 6:
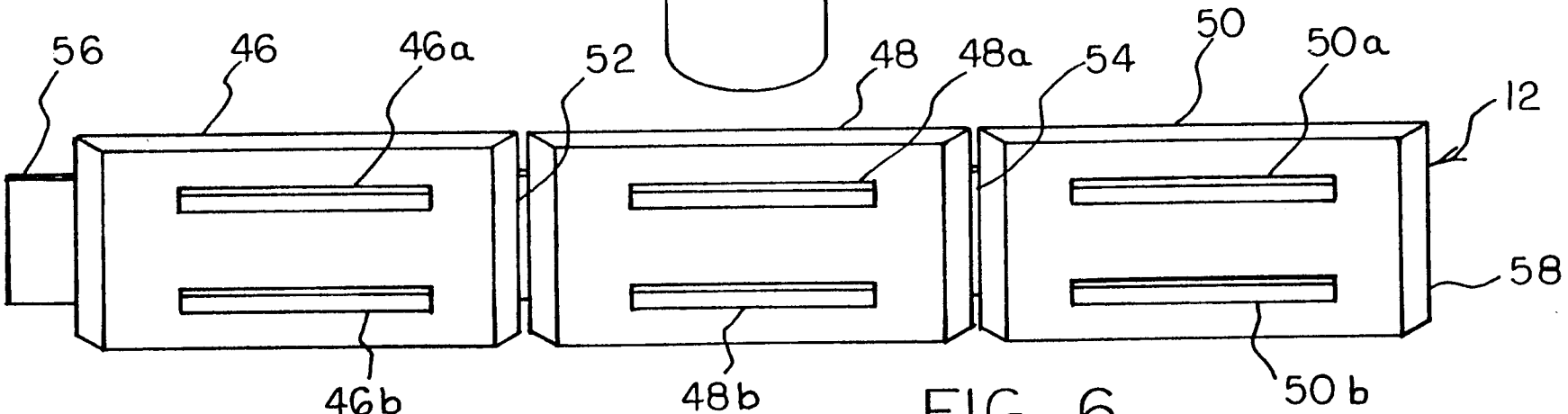
FIG. 6 is a perspective view of the holding clasp forming a part of the present invention.

FIG. 6 of the drawings illustrates the holding clasp 12 which forms a part of the invention 10 and which operates to effectively attach the same to a bottle 18. As illustrated, the clasp 12 essentially comprises a plurality of plates 46, 48, 50 which are pivotally attached together by hinges 52, 54. The hinge 52 is positioned between the plates 46, 48 and the hinge 54 is positioned between the plates 48, 50. The hinges 52, 54 can be of any conventional design although a fabric-like construction or a flexible plastic would be the most desirable material to utilize in the present case. A flexibly movably connector 56, which might comprise a hook and pile fastener such as Velcro or the like, is designed to be attached to the end 58 of the clasp 12 when it is operably attached to the neck 30 of a bottle 18.

Each of the plates 46, 48, 50 have respective topmost through-extending slots **46*a*, 48*a*, 50*a* and bottommost through-extending slots 46*b*, 48*b*, 50*b*. As best illustrated in FIGS. 2 and 3, the topmost slots 46*a*, 48*a*, 50*a* are designed to receive and retain the retaining disk 14 when the holding clasp 12 is positioned around the neck 30 of a bottle 18, while the bottommost slots 46*b*, 48*b*, 50*b* are designed to receive the flange 34 or 28 of a bottle to effectively hold the apparatus 10 in an attached relationship thereto. FIG. 3 illustrates the flexible tubes 20, 22, 24 positioned through the respective stopper apertures 40, 42, 44 and extending upwardly through the triangularly-shaped slot 36 formed in the retaining disk 14**.

Figure 7:
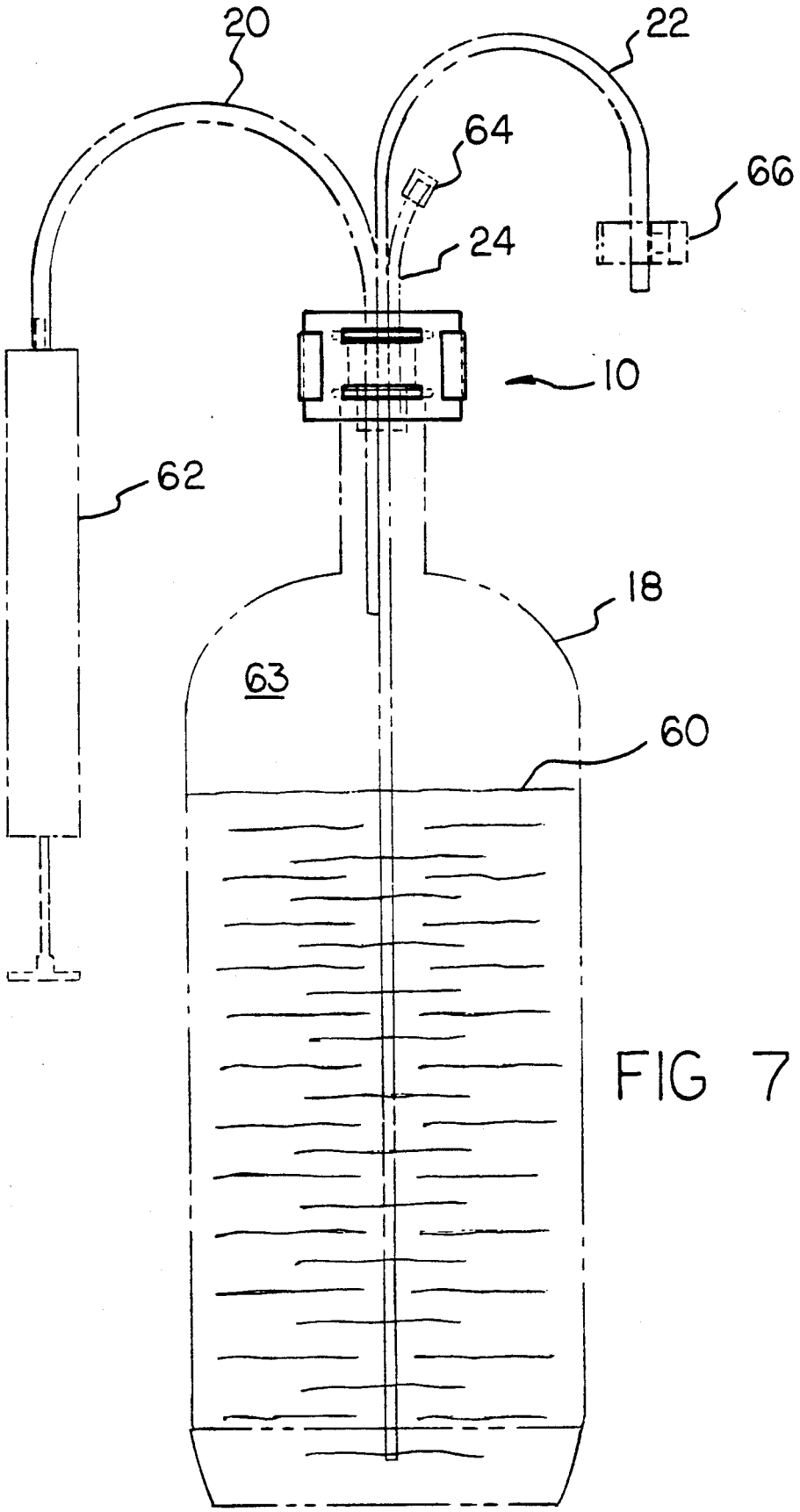
FIG. 7 is a side elevation view of the invention illustrating a use thereof with a single liquid container.

Reference is made to FIG. 7 of the drawings to illustrate a first preferred use of the invention 10. As shown, the liquid container 18 would presumably be filled with a supply of liquid 60. A manual pump 62 is designed to provide a supply of pressurized air through the conduit 20 so as to pressurize the air space 63 above the surface of the liquid 60. This effectively forces the liquid down within the container 18 whereby the liquid is then directed upwardly through the tube 22. The tube 24 is provided with a plug or clamp valve 64 so as to prevent its use when only a single liquid container 18 is connected to the invention 10. Accordingly, liquid is dispensed through the conduit 22 to any desired location in proportional response to pressurized air being supplied by the pump 62.

Figure 8:
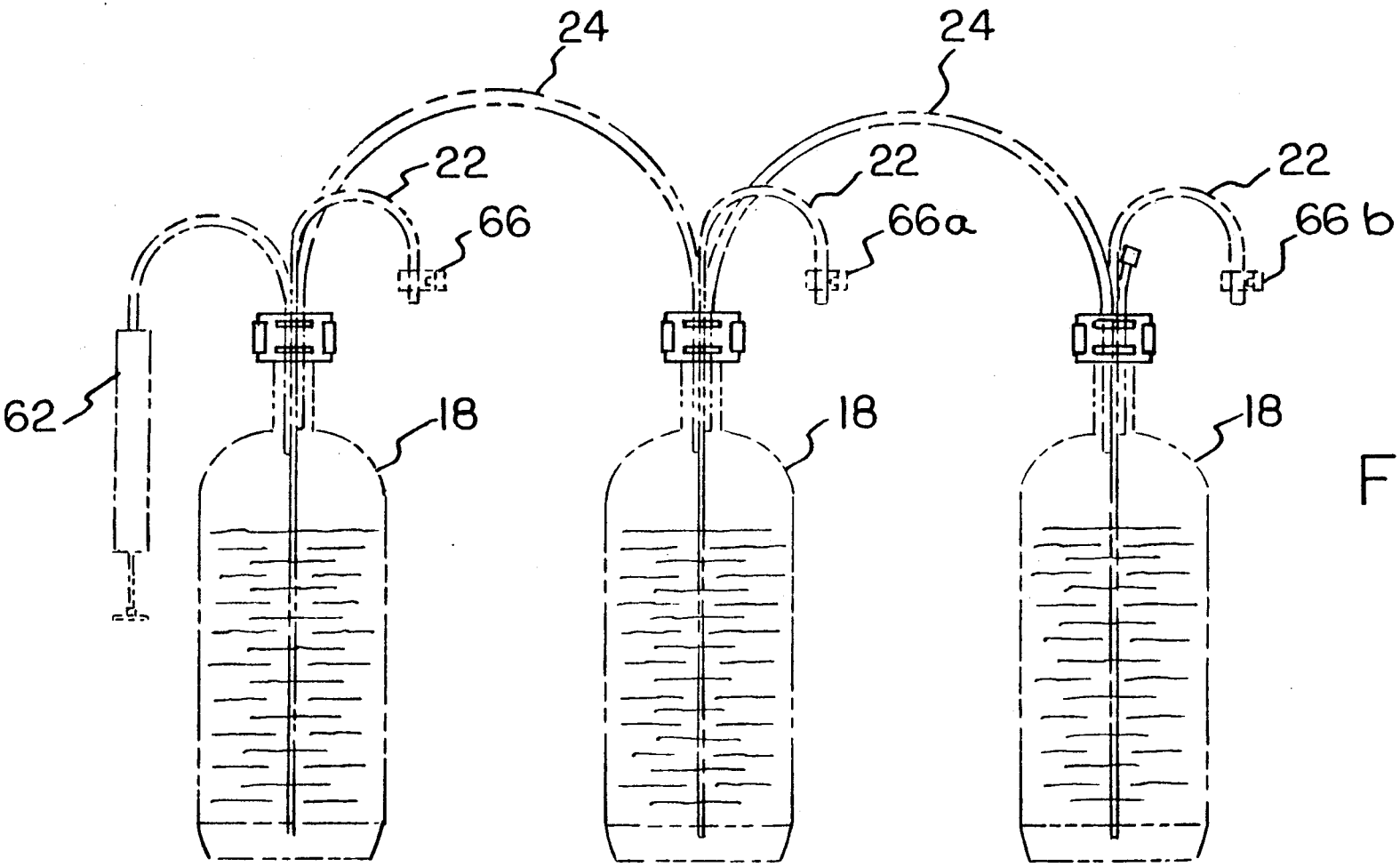
FIG. 8 is a side elevation view of the invention illustrating the same in a serial connection arrangement between a plurality of liquid containers.

FIG. 8 of the drawings illustrates the adaptability of the invention to those situations where a plurality of liquid containers **18, 18*a*, 18*b* are interconnected. In this arrangement, a single hand pump 62 may be utilized to dispense liquid from any one of the chosen containers 18, 18*a*, 18*b* by the simple manipulation of the respective clamp valves 66, 66*a*, 66*b*. In this system, the tubular member 24 is interconnected between each of the containers 18, 18*a*, 18*b* so that the pressurized air supply may be provided to the top liquid surfaces in each of the containers. As can be appreciated, the liquid in each container 18, 18*a*, 18*b* then flows upwardly through the respective tubes 22 and is prevented from being dispensed as long as the clamp valves 66, 66***a*, 66*b* are used to squeeze the tubes shut. Upon a release of any one of the clamps 66, 66*a*, 66*b*, the liquid in the particular respective container, 18, 18*a*, 18*b* will be dispensed through the associated dispensing tube 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved liquid transfer assembly for attachment to a flanged neck of a liquid container, said liquid transfer assembly comprising:

stopper means positionable as a closure in said flanged neck of said liquid container;

air pressure supplying tube means positionable through said stopper means for effecting a pressurization of an air space above a liquid surface within said liquid container;

liquid dispensing means positionable through said stopper means and being operable to direct a flow of liquid from said liquid container in response to a pressurization of air within said liquid container;

supplemental air pressure supplying tube means positionable through said stopper means and being selectively attachable to a second liquid container whereby a plurality of said liquid containers can be operably attached together to effect a selective dispensing of liquid from individual containers;

holding clasp means for effecting a locking engagement between such stopper means and said flanged neck of said liquid container, said holding clasp means including at least one slot for engaging said flanged neck of said liquid container, said holding clasp means comprising a plurality of hingedly connected plates positionable around said flanged neck of said liquid container; and retaining disk means separably positionable over said stopper means and being engageable with said holding clasp means to further effect a locking engagement between said stopper means and said flanged neck of said liquid container, said retaining disk means being in engagement with at least one further slot provided in said holding clasp means, said retaining disk means being further provided with a through-extending opening through which said air pressure supplying tube means, said liquid dispensing tube means, and said supplemental air pressure supplying tube means are directed.

2. A new and improved liquid dispensing apparatus for attachment to a flanged neck of a liquid container as described in claim 1, wherein each of said plurality of plates forming said holding clasp means are provided with at least one slot for engaging said flanged neck of said liquid container and one further slot for engaging said retaining disk means positionable over said stopper means.

* * * * *